US009815077B2

(12) United States Patent
Becker et al.

(10) Patent No.: US 9,815,077 B2
(45) Date of Patent: Nov. 14, 2017

(54) RESILIENT FLUID HOUSING

(71) Applicant: Graco Minnesota Inc., Minneapolis, MN (US)

(72) Inventors: Steven D. Becker, Blaine, MN (US); Craig J. Wojciechowski, Foley, MN (US); Harold D. Johnson, Zimmerman, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 15/111,367

(22) PCT Filed: Jan. 20, 2015

(86) PCT No.: PCT/US2015/011976

§ 371 (c)(1),
(2) Date: Jul. 13, 2016

(87) PCT Pub. No.: WO2015/109295

PCT Pub. Date: Jul. 23, 2015

(65) Prior Publication Data

US 2016/0332178 A1 Nov. 17, 2016

Related U.S. Application Data

(60) Provisional application No. 61/929,397, filed on Jan. 20, 2014.

(51) Int. Cl.
*B05B 9/04* (2006.01)
*B05B 9/08* (2006.01)
(Continued)

(52) U.S. Cl.
CPC ..... *B05B 9/0861* (2013.01); *B05B 1/3006* (2013.01); *B05B 7/0012* (2013.01);
(Continued)

(58) Field of Classification Search
CPC ... B05B 9/0861; B05B 9/0426; B05B 12/002; B05B 15/001; B05B 7/2408;
(Continued)

(56) References Cited

U.S. PATENT DOCUMENTS 4,693,423 A 9/1987 Roe et al.
4,744,516 A 5/1988 Peterson et al.
(Continued)

FOREIGN PATENT DOCUMENTS

CN 101081383 A 12/2007
CN 101939112 A 1/2011
(Continued)

OTHER PUBLICATIONS

International Search Report and Written Opinion from PCT Application Serial No. PCT/US2015/011976, dated Apr. 30, 2015, 11 pages.
(Continued)

*Primary Examiner* — Steven J Ganey
(74) *Attorney, Agent, or Firm* — Kinney & Lange, P.A.

(57) ABSTRACT

A high pressure capable fluid sprayer includes a piston pump, a main pump housing, and a spray tip. The piston pump has a piston disposed to pump a fluid. The spray tip has an outlet aperture configured to atomize and spray the fluid. The main pump housing is formed of compliant plastic and rated for at least 1600 psi, defines a main pump chamber surrounding the piston, and is disposed to receive fluid from a fluid source.

14 Claims, 3 Drawing Sheets

(51) Int. Cl.

| | |
|---|---|
| ***B05B 7/24*** | (2006.01) |
| ***B05B 1/30*** | (2006.01) |
| ***B05B 11/02*** | (2006.01) |
| ***B05B 7/00*** | (2006.01) |
| ***B65D 83/20*** | (2006.01) |
| ***B05B 15/00*** | (2006.01) |
| ***B05B 12/00*** | (2006.01) |

(52) U.S. Cl.
CPC ..... *B05B 7/2408* (2013.01); *B05B 7/2416* (2013.01); *B05B 7/2429* (2013.01); *B05B 9/0403* (2013.01); *B05B 9/0426* (2013.01); *B05B 9/0855* (2013.01); *B05B 11/02* (2013.01); *B05B 12/002* (2013.01); *B05B 15/001* (2013.01); *B65D 83/20* (2013.01)

(58) Field of Classification Search
CPC ..... B05B 11/02; B05B 9/0855; B05B 7/2416; B05B 7/0012; B05B 7/2429; B05B 9/0403; B05B 1/3006; B65D 83/20
USPC ..... 239/119, 302, 320, 323, 332, 351, 337, 239/338, 340, 373, 533.1, 533.15, 602, 239/DIG. 19
See application file for complete search history.

(56) References Cited

U.S. PATENT DOCUMENTS

| | | | | |
|---|---|---|---|---|
| 6,981,658 | B2 * | 1/2006 | Streutker | B05B 9/0861 239/332 |
| 7,891,588 | B2 * | 2/2011 | Jones | B05B 9/01 239/DIG. 14 |
| 8,596,555 | B2 * | 12/2013 | Thompson | B05B 9/01 239/332 |
| 9,016,599 | B2 * | 4/2015 | Johnson | B05B 9/0861 239/332 |
| 2003/0025002 | A1 | 2/2003 | Hughes | |
| 2007/0278787 | A1 | 12/2007 | Jones et al. | |
| 2009/0145980 | A1 | 6/2009 | Jones | |
| 2009/0272260 | A1 | 11/2009 | Moreno et al. | |
| 2010/0294805 | A1 | 11/2010 | Pohlmann et al. | |
| 2011/0114756 | A1 | 5/2011 | Munn | |
| 2012/0037726 | A1 | 2/2012 | Johnson et al. | |

FOREIGN PATENT DOCUMENTS

| | | | |
|---|---|---|---|
| CN | 201913031 | U | 8/2011 |
| CN | 102202802 | A | 9/2011 |
| WO | WO2010/047800 | A2 | 4/2010 |

OTHER PUBLICATIONS

Extended European Search Report for EP Application No. 15737153.5, dated Jun. 14, 2017, 8 pages.
First Chinese Office Action from Chinese Appln. No. 2015800049684, dated Jul. 18, 2017, 14 pages.

* cited by examiner

RESILIENT FLUID HOUSING

BACKGROUND

The present invention relates generally to fluid spraying systems. More particularly, the invention relates to a resilient fluid housing for a spraying system.

Fluid spraying systems are commonly used in a wide variety of applications, from industrial assembly to home painting. Handheld sprayers can be used by a human operator, while automated sprayers are typically used in mechanized manufacturing processes. Pressure within fluid spraying systems fluctuates during normal operation. In practice, peak operating pressures define the minimum structural requirements of spraying systems, because fluid volumes within such systems must operate under all pressure conditions. For this reason, conventional high-pressure capable spraying systems use rigid, heavy housings typically formed of metal.

SUMMARY

A high pressure capable fluid sprayer includes a piston pump, a main pump housing, and a spray tip. The piston pump has a piston disposed to pump a fluid. The spray tip has an outlet aperture configured to atomize and spray the fluid. The main pump housing is formed of compliant plastic and rated for at least 1600 psi, defines a main pump chamber surrounding the piston, and is disposed to receive fluid from a fluid source.

While the above-identified drawing figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale.

DETAILED DESCRIPTION

The present invention relates to a fluid sprayer such as a hand-held paint spraying system. The sprayer has interior volumes primarily defined by housings formed of compliant plastic. These compliant housings distend in response to high pressures that occur during sprayer operation, thereby reducing pressure within the sprayer and allowing the sprayer to operate at peak pressures without the need for heavy rigid housings.

Figure 1:
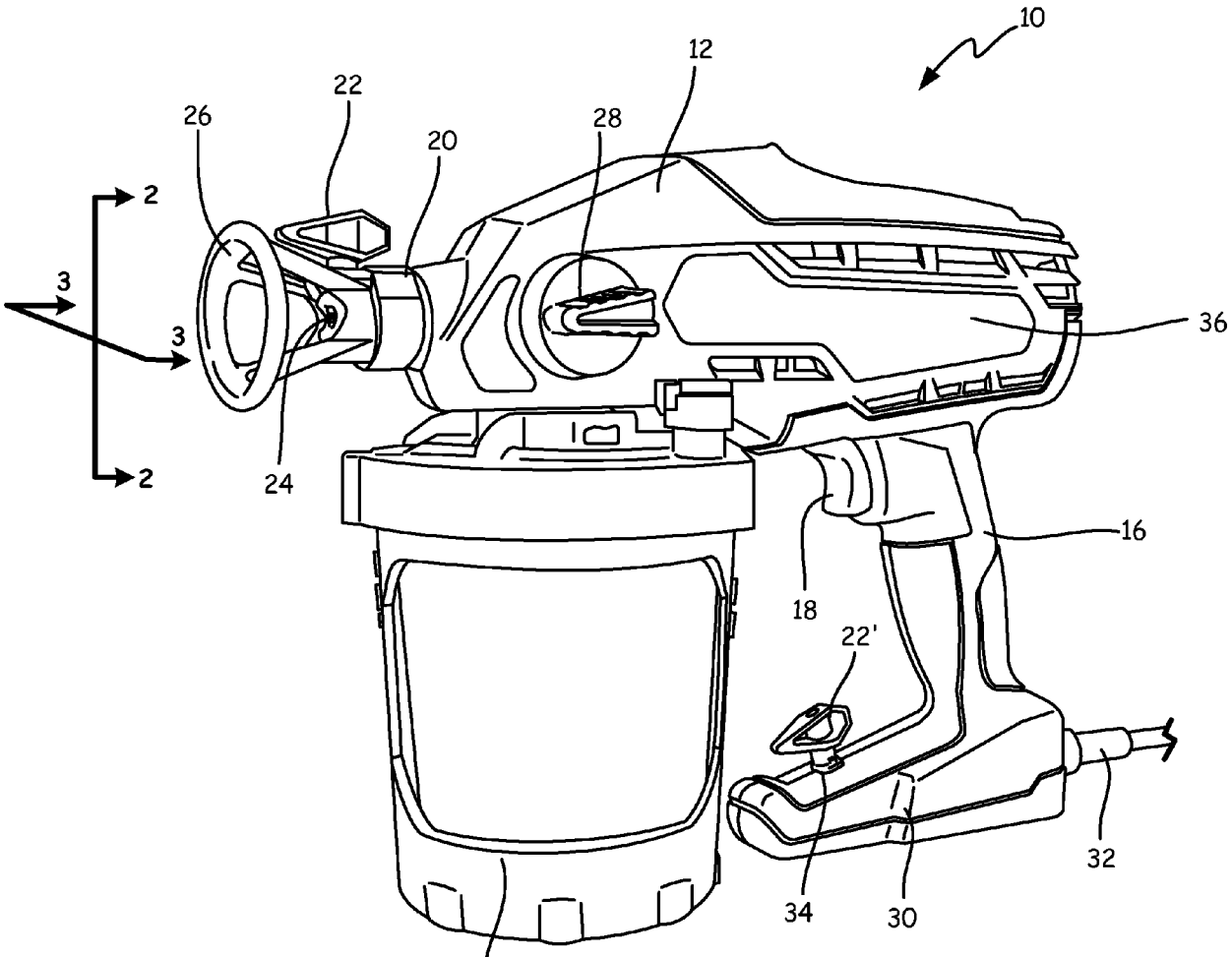
FIG. 1 is a perspective view of a fluid sprayer.

FIG. 1 is a perspective view of sprayer 10, a handheld fluid sprayer according to one embodiment of the present invention. Sprayer 10 includes body 12, source 14, grip 16, trigger 18, nozzle 20, spray tips 22 (with outlet aperture 24) and 22', guard 26, prime valve assembly 28, base 30, power cord 32, storage slot 34, and pump 36. In the depicted embodiment, sprayer 10 can, for example, be an electrical spray device for use with paint, solvent, or other fluids.

Although sprayer 10 is illustrated as a hand-held device, stationary or machine-driven sprayers can also utilize the spray tip of the present invention.

Body 12 of sprayer 10 includes pumping elements suitable to drive fluid from source 14 towards nozzle 20, and expel fluid from outlet aperture 24 of spray tip 22. In the depicted embodiment, body 12 houses pump 36. Pump 36 can, for example, be an electric motorized piston pump that receives power through power cord 32, or from an integral battery pack (not shown). Pump 36 produces high pressures via aggressive pressure spikes, unlike gentler pumping mechanisms such as diaphragm or impeller pumps. Grip 16 provides a hand-hold for a human user. When the user depresses trigger 18, sprayer 10 draws fluid from source 14 through body 12, and expels this fluid through nozzle 20. Trigger 18 can, for example, actuate pump 36. Although source 14 is depicted as a substantially cylindrical fluid receptacle carried by body 12, alternative embodiments of source 14 can include receptacles of other shapes and sizes, as well as fluid lines or hoses connectable to external fluid supplies. Source 14 can, for example, be a disposable paint container such as a deflating bag. Prime valve assembly 28 can be used to prime pumping elements within body 12 prior to spraying fluid from source 14.

Nozzle 20 houses spray tip 22. Spray tip 22 can, for example, be a removable element with a substantially cylindrical portion insertable into nozzle 20 to provide a desired spray pattern, as depicted and described in further detail below with respect to FIG. 2. Spray tip 22 includes outlet aperture 24, a ground or otherwise machined narrow aperture that atomizes spray fluid and defines a spray pattern. Sprayer 10 can accept various spray tips 22, e.g. spray tips 22 and 22' with different outlet apertures 24 capable of producing different spray patterns suitable for different applications. For example, a spray tip 22 that produces a wide spray pattern can be swapped out for a spray tip 22' that produces a narrow spray pattern when precision spraying is required. In the depicted embodiment, base 30 provides attachment point for power cord 32, and houses storage slot 34 for one such reserve or alternate spray tip 22'. Nozzle 20 is protected by guard 26, a rigid or semi-rigid positioning element. In the depicted embodiment, guard 26 is an elliptical frame situated forward of spray tip 22.

Figure 2:
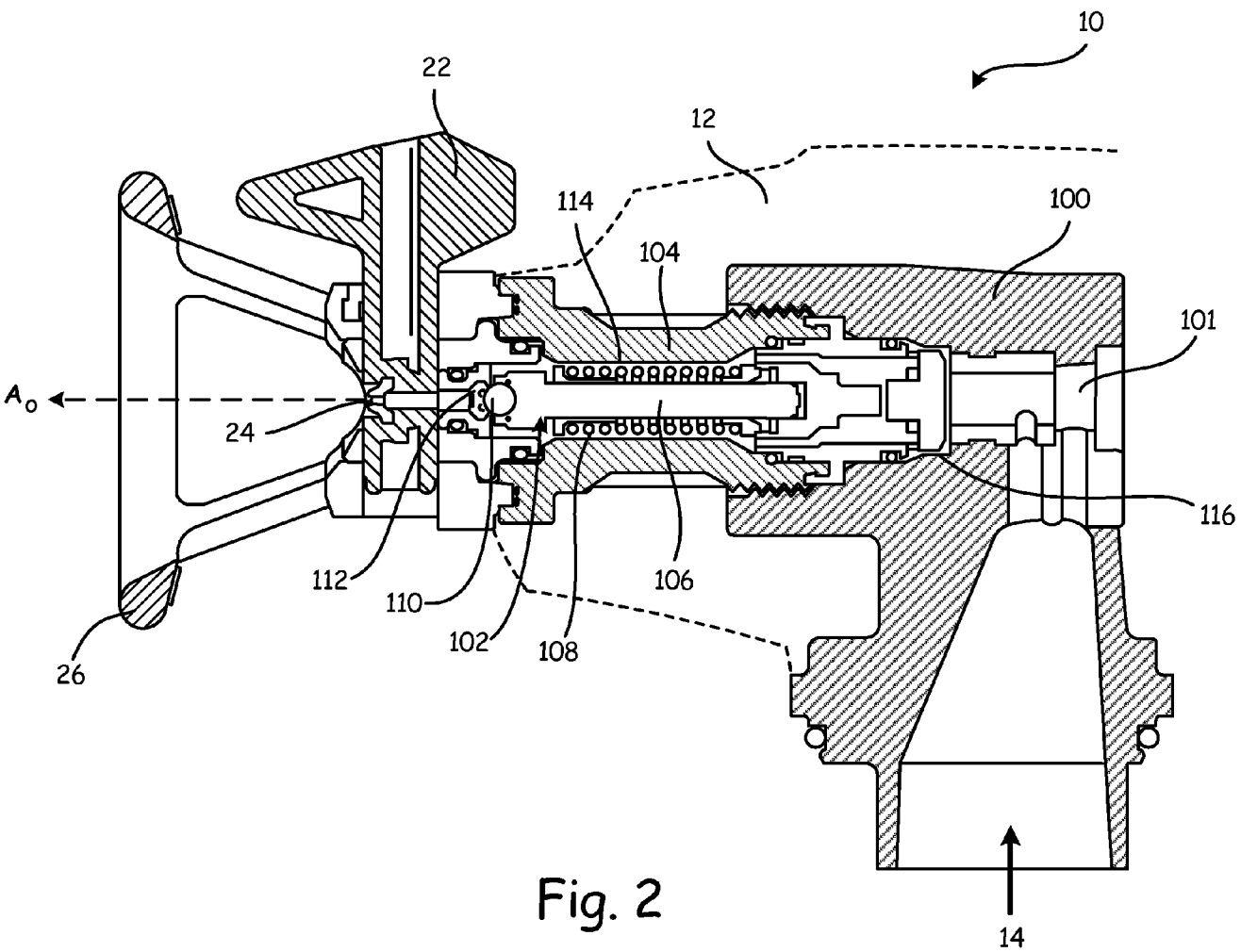
FIG. 2 is a first cross-sectional view of the fluid sprayer, taken along line 2-2 of FIG. 1, illustrating fluid chambers within the sprayer.
Figure 3:
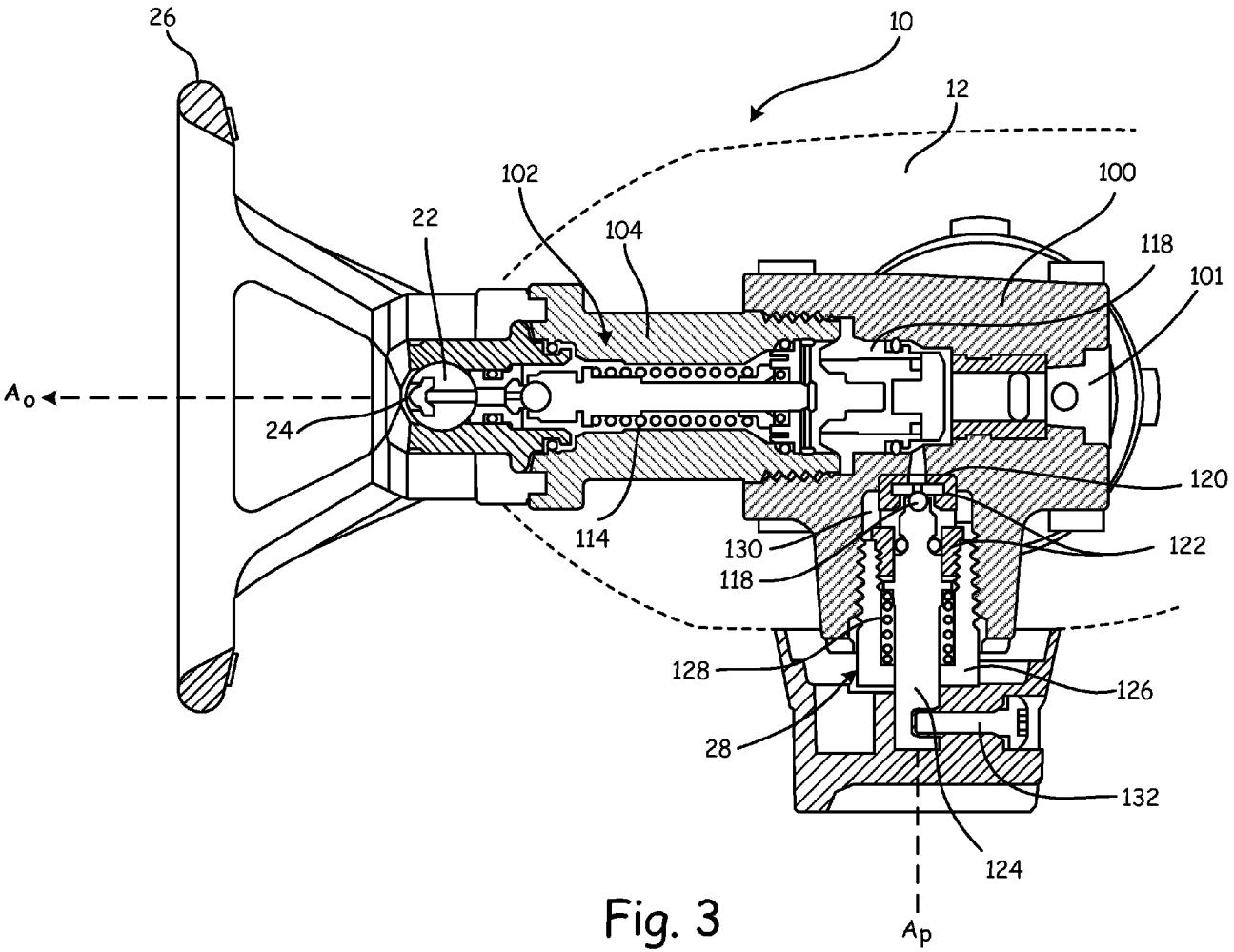
FIG. 3 is a second cross-sectional view of the fluid sprayer, taken along line 3-3 of FIG. 1, illustrating fluid chambers within the sprayer.

FIGS. 2 and 3 are cross-sectional views of a portion of sprayer 10 through orthogonal section planes 2-2 and 3-3, respectively, of FIG. 1. FIG. 2 illustrates body 12, spray tip 22, outlet aperture 24, guard 26, main pump housing 100, main pump chamber 101, outlet check valve assembly 102 (with outlet check valve housing 104, outlet check valve rod 106, outlet check valve bias element 108, outlet check valve sealing element 110, outlet check valve seat 112, and outlet check valve chamber 114), and intermediate channel housing 116. FIG. 3 similarly illustrates 2 illustrates body 12, spray tip 22, outlet aperture 24, guard 26, main pump housing 100, main pump chamber 101, outlet check valve assembly 102, and intermediate channel housing 116, and further illustrates prime valve assembly 28 (with prime valve sealing element 118, prime valve seat 120, prime valve seat housing 122, prime valve rod 124, prime valve rod housing 126, prime valve bias element 128, prime valve chamber 130, and prime valve pin 132).

Main pump housing 100 defines main pump chamber 101, which houses a piston of pump 36 (see FIG. 1) to force fluid from source 14 into main pump chamber 102, and propel fluid out outlet aperture 24 of spray tip 22. Prime valve assembly 28 can be opened by removing prime pin 132, thereby drawing fluid up from source 14 into main pump chamber 101 and allowing normal pumping of fluid through outlet aperture 24 to commence. Outlet check valve assembly 102 and prime valve assembly 28 are pressure-actuated check valve assemblies that open in response to high internal fluid pressure within sprayer 10. Prime valve assembly 28 opens only when prime pin 132 is disengaged from prime valve rod 124. Outlet check valve assembly 102 prevents leaking or dripping of fluid through outlet aperture 24 of spray tip 22. To this end, outlet check valve sealing element 110 of outlet check valve assembly 102 is situated close to spray tip 22, so that a fluid volume between outlet aperture 24 and outlet check valve sealing element 110 is low.

During ordinary operation, outlet check valve sealing element 110 and prime valve sealing element 118 are retained against outlet check valve seat 112 and prime valve seat 120, respectively, by outlet check valve rod 106 and prime valve rod 124. Outlet check valve rod 106 and prime valve rod 124 are in turn biased to "closed" positions by outlet check valve bias element 114 and prime valve bias element 128, respectively. In the illustrated embodiment, prime and outlet check valve bias elements 113 and 128 are springs disposed coaxially with prime valve rod 106 and outlet check valve rod 124, respectively. Outlet check valve sealing element 110 and prime valve sealing element 118 can, for example, be valve balls, as shown. In alternative embodiments, outlet check valve sealing element 110 and prime valve sealing element 118 can, for example, be pins or other shapes that mate with corresponding faces on outlet check valve seat 112 and prime valve seat 120. Outlet check valve rod 106 reciprocates along an axis $A_O$ within outlet check valve housing 104, which defines outlet check valve chamber 114. Fluid pressure within check valve chamber 114 above a threshold actuation valve $P_{actO}$ overcomes a substantially constant closing force exerted by outlet check valve bias element 108, causing outlet check valve sealing element 110 to recede from outlet check valve seat 112, opening outlet check valve assembly 102. Prime valve assembly 28 operates analogously while prime valve pin 132 is disengaged: prime valve rod 124 reciprocates along axis $A_P$, allowing prime valve sealing element 118 to separate from prime valve seat 120.

Outlet check valve seat 112 and prime valve seat 120 are rigid, durable elements with geometries suited to receive sealing elements 110 and 118, respectively, in tight seals. In one embodiment, outlet check valve seat 112 and prime valve seat 120 are formed of tungsten carbide blanks ground or otherwise machined to mate smoothly with sealing elements 110 and 118, respectively.

Main pump housing 100, outlet check valve housing 104, and prime valve seat housing 122 define main pump chamber 101, outlet check valve chamber 114, and prime valve chamber 130, respectively. Main pump chamber 101, outlet check valve chamber 114, and prime valve chamber 130 together make up the majority of fluid-accessible volume of the sprayer 10. Sprayer 10 is a high pressure-capable fluid sprayer rated for pressures in excess of 360 psi. In one embodiment, sprayer 10 is rated for pressures in excess of 1000 psi, and main pump housing 100, outlet check valve housing 104, and prime valve seat housing 122 must accordingly be resilient to high pressures. In a further embodiment, sprayer 10 is rated for pressures in excess of 2000 psi. In one embodiment, main pump housing 100, outlet check valve housing 104, and prime valve seat housing 122 are capable of operating under peak pressures exceeding 2000 psi. Main pump housing 100, outlet check valve housing 104, and prime valve seat housing 122 are each formed of compliant plastic, e.g. of molded acetal or nylon. In one embodiment, main pump housing 100, outlet check valve housing 104, and prime valve seat housing 122 each have Young's modulus less than 1,000,000 psi. In a further embodiment, outlet check valve housing 104 and prime valve seat housing 122 each have Young's modulus between 290,000 and 400,000 psi, while main pump housing 100 has Young's modulus of 750,000 or less. Main pump housing 100, outlet check valve housing 104, and prime valve seat housing 122 are externally exposed to atmospheric pressures, are each sufficiently thin-walled to be capable distending laterally (i.e. radially outward from axes $A_O$ or $A_P$) under heavy internal pressure loads, unlike the heavy, rigid housing structures (formed, e.g. of aluminum) conventionally used to satisfy the demanding structural requirements of high-pressure sprayers.

The compliant structure of main pump housing 100, outlet check valve housing 104, and prime valve seat housing 122 reduces pressure spikes within main pump chamber 101, outlet check valve chamber 114, and prime valve chamber 130. Where analogous sprayer systems using rigid fluid housings might experience internal pressures of up to 4000 psi, for example, the compliant housings of the present invention reduce internal pressure to less than 2000 psi. In one embodiment, the present invention reduces average internal fluid pressures to approximately 1000 psi, or less than 1200 psi, and peak internal fluid pressures to approximately 1500 psi, or less than 1800 psi. In general, the use of compliant material in pump housing 100, outlet check valve housing 104, and prime valve housing 122 reduces peak pressures inside sprayer 10 by at least 30%, and in some cases by more than 50%. As a result of this pressure reduction, housing 100, outlet check valve housing 104, and prime valve seat housing 122 can be designed towards more lenient structural requirements, and can be relatively light and inexpensive without sacrificing structural integrity.

Discussion of Possible Embodiments

The following are non-exclusive descriptions of possible embodiments of the present invention.

A high pressure-capable fluid sprayer comprising: a piston pump with a piston disposed to pump a fluid; a spray tip having an outlet aperture configured to atomize and spray the fluid; and a main pump housing formed of compliant polymer, defining a main pump chamber surrounding the piston, disposed to receive fluid from the fluid source, and rated for at least 360 psi.

The fluid sprayer of the preceding paragraph can optionally include, additionally and/or alternatively, any one or more of the following features, configurations and/or additional components:

A further embodiment of the foregoing fluid sprayer, further comprising an outlet check valve assembly with an outlet check valve housing defining an outlet check valve chamber disposed between the spray tip and the main pump chamber.

A further embodiment of the foregoing fluid sprayer, wherein the outlet check valve assembly is formed of compliant polymer.

A further embodiment of the foregoing fluid sprayer, wherein the outlet check valve assembly includes a valve ball and valve seat situated at least three times as far from the main pump housing as from the spray tip.

A further embodiment of the foregoing fluid sprayer, wherein the main pump chamber and the outlet check valve chamber together comprise the majority of a fluid-accessible volume of the fluid sprayer.

A further embodiment of the foregoing fluid sprayer, further comprising a prime valve assembly fluidly connected to the main pump chamber and operable to prime the fluid sprayer, the prime valve assembly having a prime valve housing defining a prime valve chamber.

A further embodiment of the foregoing fluid sprayer, wherein at least a portion of the prime valve housing is formed of compliant plastic.

A further embodiment of the foregoing fluid sprayer, wherein the main pump housing and the outlet check valve housing each have Young's modulus less than 1,000,000 psi.

A further embodiment of the foregoing fluid sprayer, wherein the main pump housing and the outlet check valve housing are capable of withstanding at least 1000 psi pressure spikes.

A further embodiment of the foregoing fluid sprayer, wherein at least one of the outlet check valve housing and the main pump housing is formed of acetal or nylon.

A further embodiment of the foregoing fluid sprayer, wherein compliance of the main pump housing prevents peak internal fluid pressures within the fluid-accessible volume from exceeding 1800 psi.

A further embodiment of the foregoing fluid sprayer, wherein compliance of the main pump housing prevent average internal fluid pressures within the fluid-accessible volume from exceeding 1200 psi.

Summation

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal, rotational or vibrational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A high pressure-capable fluid sprayer comprising:

a piston pump with a piston disposed to pump a fluid, the piston placing the fluid under pressure in excess of 360 pounds per square inch;

a spray tip having an outlet aperture configured to atomize and spray the fluid; and a main pump housing formed of compliant polymer, defining a main pump chamber surrounding the piston, and disposed to receive fluid from a fluid source, the main pump housing having a wall exposed to atmospheric pressure during pumping by the piston pump; and an outlet valve assembly with an outlet valve housing defining an outlet valve chamber disposed between the spray tip and the main pump chamber, the outlet valve housing formed of compliant polymer and having a wall exposed internally to the fluid output from the piston pump under pressure and externally to atmospheric pressure during pumping by the piston pump, wherein one or both of the walls of the main pump and the outlet valve housing distend outwardly during pumping due to the fluid pressure generated by the piston to reduce pressure spikes of the fluid being pumped.

2. The high pressure-capable fluid sprayer of claim 1, wherein the outlet valve assembly includes a valve ball and valve seat situated at least three times as far from the main pump housing as from the spray tip.

3. The high pressure-capable fluid sprayer of claim 1, wherein the main pump chamber and the outlet valve chamber together comprise the majority of a fluid-accessible volume of the fluid sprayer.

4. The high pressure-capable fluid sprayer of claim 3, wherein compliance of the main pump housing prevents peak internal fluid pressures within the fluid-accessible volume from exceeding 1800 psi.

5. The high pressure-capable fluid sprayer of claim 3, wherein compliance of the main pump housing prevent average internal fluid pressures within the fluid-accessible volume from exceeding 1200 psi.

6. The high pressure-capable fluid sprayer of claim 1, further comprising a prime valve assembly fluidly connected to the main pump chamber and operable to prime the fluid sprayer, the prime valve assembly having a prime valve housing defining a prime valve chamber.

7. The high pressure-capable fluid sprayer of claim 6, wherein at least a portion of the prime valve housing is formed of compliant plastic.

8. The high pressure-capable fluid sprayer of claim 1, wherein the main pump housing and the outlet valve housing each have Young's modulus less than 1,000,000 psi.

9. The high pressure-capable fluid sprayer of claim 1, wherein the main pump housing and the outlet valve housing are capable of withstanding at least 1000 psi pressure spikes.

10. The high pressure-capable fluid sprayer of claim 1, wherein at least one of the outlet valve housing and the main pump housing is formed of acetal or nylon.

11. The high pressure-capable fluid sprayer of claim 1, wherein the walls of the main pump distends outwardly during pumping due to the fluid pressure generated by the piston to reduce pressure spikes of the fluid being pumped.

12. The high pressure-capable fluid sprayer of claim 1, wherein the wall of the outlet valve housing distends outwardly during pumping due to the fluid pressure generated by the piston to reduce pressure spikes of the fluid being pumped.

13. The high pressure-capable fluid sprayer of claim 1, wherein both of the walls of the main pump and the outlet valve housing distend outwardly during pumping due to the fluid pressure generated by the piston to reduce pressure spikes of the fluid being pumped.

14. A high pressure-capable fluid sprayer comprising:

a piston pump with a piston disposed to pump a fluid, the piston placing the fluid under pressure in excess of 360 pounds per square inch;

a spray tip having an outlet aperture configured to atomize and spray the fluid; and a main pump housing defining a main pump chamber surrounding the piston, and disposed to receive fluid from a fluid source; and an outlet check valve assembly with an outlet valve housing defining an outlet valve chamber disposed between the spray tip and the main pump chamber, the outlet valve housing being tubular and containing at least part of a check valve, the outlet valve housing formed of compliant polymer and having a wall exposed internally to the fluid output from the piston pump under pressure and externally to atmospheric pressure during pumping by the piston pump, wherein the wall of the outlet valve housing distends outwardly during pumping due to the fluid pressure generated by the piston to reduce pressure spikes of the fluid being pumped.

* * * * *